US006479790B1

(12) United States Patent
Graham et al.

(10) Patent No.: US 6,479,790 B1
(45) Date of Patent: Nov. 12, 2002

(54) DUAL LASER SHOCK PEENING

(75) Inventors: Michael Evans Graham, Slingerlands, NY (US); John Dennis Jackson, Wyoming, OH (US)

(73) Assignee: General Electric Company

( * ) Notice: Subject to any disclaimer, the term of this patent is extended or adjusted under 35 U.S.C. 154(b) by 0 days.

(21) Appl. No.: 09/494,715

(22) Filed: Jan. 31, 2000

(51) Int. Cl.[7] ..... B23K 26/00; B23K 26/02

(52) U.S. Cl. ..... 219/121.85; 219/121.79; 219/121.83

(58) Field of Search ..... 219/121.6, 121.85, 219/121.77, 121.78, 121.83, 79.8, 82, 121.79, 121.8, 121.76; 700/166

(56) References Cited

U.S. PATENT DOCUMENTS 4,638,143 A * 1/1987 Akeel ..... 219/121.63
4,937,421 A * 6/1990 Ortiz, Jr. et al. ..... 219/121.68
4,987,044 A * 1/1991 Vassiliou ..... 430/20
5,072,091 A * 12/1991 Nagata et al. ..... 219/121.68
5,216,222 A * 6/1993 Masuda ..... 219/121.78
5,239,159 A * 8/1993 Masuda ..... 219/121.78
5,268,554 A 12/1993 Ream
5,340,962 A * 8/1994 Schmidt et al. ..... 219/121.78
5,492,447 A * 2/1996 Mannava et al. ..... 415/200
5,531,570 A * 7/1996 Mannava et al. ..... 416/241 R
5,569,018 A * 10/1996 Mannava et al. ..... 415/200
5,591,009 A * 1/1997 Mannava et al. ..... 416/241 R
5,674,329 A * 10/1997 Mannava et al. ..... 148/525
5,756,965 A * 5/1998 Mannava ..... 219/121.85
5,822,211 A * 10/1998 Barenboim et al. .... 364/474.08
5,904,869 A * 5/1999 Saito et al. ..... 219/121.68
5,911,891 A * 6/1999 Dulaney et al. ..... 219/121.85
5,932,120 A * 8/1999 Mannava et al. ..... 219/121.85
6,002,706 A * 12/1999 Staver et al. ..... 372/108
6,005,219 A * 12/1999 Rockstroh et al. ..... 219/121.85
6,058,132 A * 5/2000 Iso et al. ..... 372/108
6,068,728 A * 5/2000 Xuan ..... 156/345
6,075,593 A * 6/2000 Trantow et al. ..... 356/318
6,087,625 A * 7/2000 Iso ..... 219/121.8
6,144,012 A * 11/2000 Dulaney et al. ..... 219/121.85
6,215,097 B1 * 4/2001 Mannava ..... 219/121.69
6,236,016 B1 * 5/2001 Dulane et al. ..... 219/121.85
6,292,584 B1 * 9/2001 Dulaney et al. ..... 382/151

* cited by examiner

*Primary Examiner*—Tom Dunn
*Assistant Examiner*—Zidia T. Pittman
(74) *Attorney, Agent, or Firm*—David C. Goldman; Enrique J. Mora; Beusse, Brownlee, Bowdoin & Wolter, PA

(57) ABSTRACT

A method and system for dual laser shock peening an article are provided. The method allows for defining a spot pattern comprising a plurality of spots on a first surface of the article to be peened. The method further allows for defining a spot pattern comprising a plurality of spots on a second surface of the article to be peened. The first and second surfaces comprise mutually opposite surfaces relative to one another. Each one of the respective spots on the second surface is arranged to correspond to a respective spot on the first surface and comprising a plurality of matched pair of spots. A generating step allows for generating dual laser beams being respectively aligned to simultaneously impinge on each respective matched pair of spots.

24 Claims, 7 Drawing Sheets

DUAL LASER SHOCK PEENING

BACKGROUND OF THE INVENTION

This invention is generally related to laser shock peening and, more particularly, is related to a method and system for controlling dual laser shock peening of an article.

Gas turbine engines and, in particular, aircraft gas turbine engines rotors operate at high rotational speeds that produce high tensile and vibratory stress fields within the blade and make the fan blades susceptible to foreign object damage (FOD). Vibrations may also be caused by vane wakes and inlet pressure distortions as well as other aerodynamic phenomena. This FOD causes nicks and tears and hence stress concentrations in leading and trailing edges of fan blade airfoils. These nicks and tears become the source of high stress concentrations or stress risers and severely limit the life of these blades due to High Cycle Fatigue (HCF) from vibratory stresses.

Thus, it is highly desirable to design and construct longer lasting fan and compressor blades, as well as other hard metallic parts, that are better able to resist both low and high cycle fatigue and that can arrest cracks better than present day parts. The below referenced U.S. Patent Applications or U.S. Patents are directed towards this end: U.S. patent application Ser. Nos. 08/993,194, now U.S. Pat. No. 5,932,120, entitled "Laser Shock Peening Using Low Energy Laser"; Ser. No. 08/362,362, "On The Fly Laser Shock Peening", filed Dec. 22, 1994, now U.S. Pat. No. 6,215,097; and U.S. Pat. No. : 5,591,009, entitled "Laser Shock Peened Gas Turbine Enginer Fan Blade Edges"; U.S. Pat. No. 5,569,018, entitled "Technique To Prevent Or Divert Cracks"; U.S. Pat. No. 5,531,570, entitled "Distortion Control For Laser Shock Peened Gas Turbine Engine Compressor Blade Edges"; U.S. Pat. No. 5,492,447, entitled "Laser Shock Peened Rotor Components For Turbomachinery"; U.S. Pat. No. 5,674,329, entitled "Adhesive Tape Covered Laser Shock Peening"; and U.S. Pat. No. 5,674,328, entitled "Dry Tape Covered Laser Shock Peening", all of which are assigned to the present Assignee. They teach to provide an airfoil of a fan blade with a continuous or volumetric region of deep compressive residual stresses imparted by laser shock peening over at least an inwardly extending portion of laser shock peened surfaces of an article, such as the fan blade. These regions are formed by multiple overlapping protrusions of compressive residual stresses imparted by laser shock peening that extend inward from overlapping laser shock peened circles or spots.

The deep compressive residual stresses imparted by laser shock peening of the present invention is not to be confused with a surface layer zone of a work piece that contains locally bounded compressive residual stresses that are induced by a hardening operation using a laser beam to locally heat and thereby harden the work piece such as that which is disclosed in U.S. Pat. No. 5,235,838, entitled "Method and apparatus for truing or straightening out of true work pieces". The prior art teaches the use of multiple radiation pulses from high powered pulsed lasers and large laser spot diameters of about 1 cm to produce shock waves on the surface of a work piece similar like the above referenced Patent Applications and U.S. Pat. No. 3,850,698, entitled "Altering Material Properties"; U.S. Pat. No. 4,401,477, entitled "Laser shock processing"; and U.S. Pat. No. 5,131,957, entitled "Material Properties". Laser shock peening as understood in the art and as used herein, means utilizing a laser beam from a laser beam source to produce a continuous region of strong compressive residual stresses in a continuous region on a portion of a surface. The region is volumetric and produced by the coalescence of individual protrusions extending inward from overlapping laser shock peened circles or spots. Laser peening has been utilized to create a compressively stressed protection layer at the outer surface of a workpiece which is known to considerably increase the resistance of the workpiece to fatigue failure as disclosed in U.S. Pat. No. 4,937,421, entitled "Laser Peening System and Method". Manufacturing costs of the laser shock peening process is a great area of concern because startup and operational costs can be very expensive. The "on the fly" laser shock peening process disclosed in U.S. Pat. No. 6,215,097, above is designed to provide cost saving methods for laser shock peening as is the present invention. Prior art teaches to use large laser spots, on the order of 1 cm and greater in diameter, and high powered lasers. Manufacturers are constantly seeking methods to reduce the time, cost, and complexity of such processes. A laser shock peening method that uses a low power laser beam, on the order of 3–10 joules, with a preferred range of 3–7 Joules and laser beam spots having a diameter of about 1 mm is disclosed in co-pending U.S. Pat. No. 5,932,120, entitled "Laser Shock Peening Using Low Energy Laser" and this method is directed to reducing time, cost, and complexity of laser shock peening. There is an ever present desire to design techniques that result in such reductions and to this end the present invention is directed.

As suggested above, known prior art laser peening techniques have been solely concerned with the use of a single laser beam that struck the surface to be peened at a designated position, at a designated angle. Recent advances in laser shock peening technology may require that the article be simultaneously struck on mutually opposite surfaces so that the respective shock waves created by the two impinging laser beams meet at the center of the opposite surfaces. See U.S. Pat. No. 6,005,219, issued to the same Assignee of the present invention and herein incorporated by reference. Manufacturing use of this dual laser technique imposes a need for developing programmable tools, such as numerical control (NC) tools, that allow for accurately, reliably and inexpensively controlling the dual laser peening process.

Thus, it is desirable to be able to provide an automated process for developing commands for controlling a dual laser shock peening device using presently available NC part-positioning technology. It is further desirable to be able to accurately and quickly position the article relative to the dual laser beams so that each laser beam simultaneously impinges on a respective spot situated on either of the mutually opposite surfaces. Since the respective spots which are simultaneously struck by the two laser beams lie opposite one another on mutually opposite surfaces of the article, it is also desirable to be able to determine the precise location of the spots at which the beams must strike the article to achieve a desired surface coverage and strong compressive residual stresses. As suggested above, it would also be desirable to be able to determine the command strategy, e.g., NC commands, to be programmed into the article-positioning device to three-dimensionally align the article to spatial locations that achieve the appropriate coverage.

BRIEF SUMMARY OF THE INVENTION

Generally speaking, the present invention fulfills the foregoing needs by providing a method for dual laser shock peening an article. The method allows for defining a spot pattern comprising a plurality of spots on a first surface of the article to be peened. The method further allows for defining a spot pattern comprising a plurality of spots on a second surface of the article to be peened. The first and second surfaces comprise mutually opposite surfaces relative to one another. Each one of the respective spots on the second surface is arranged to correspond to a respective spot on the first surface and comprising a plurality of matched pair of spots. A generating step allows for generating dual laser beams being respectively aligned to simultaneously impinge on each respective matched pair of spots.

In another aspect of the invention, the foregoing needs are further fulfilled by providing a system for dual laser shock peening an article. The system comprises a spot pattern generator for defining a spot pattern comprising a plurality of spots on a first surface of the article to be peened. The pattern generator further defines a spot pattern comprising a plurality of spots on a second surface of the article to be peened. The first and second surfaces comprise mutually opposite surfaces relative to one another. Further, each one of the respective spots on the second surface is arranged to correspond to a respective spot on the first surface and comprises a plurality of matched pair of spots. A laser unit allows for generating dual laser beams that are respectively aligned to simultaneously impinge on each respective matched pair of spots.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 2:
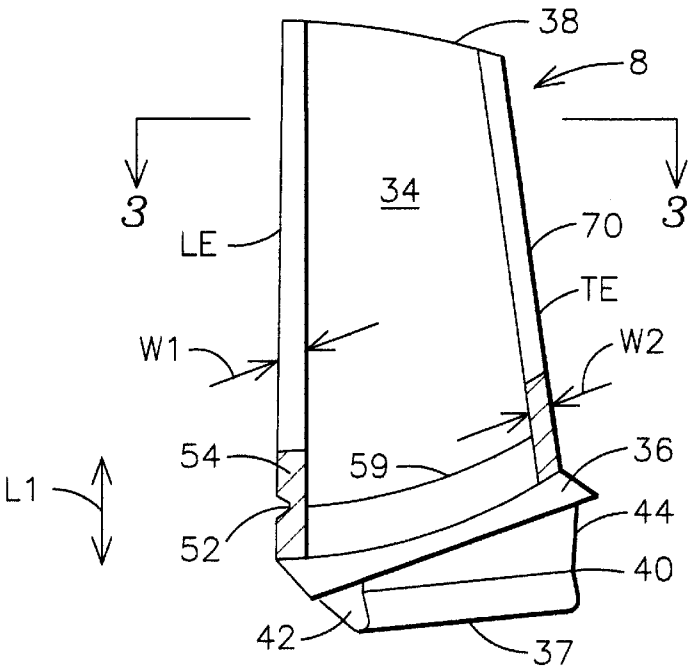
FIG. 2 is a perspective illustrative view of another exemplary aircraft gas turbine engine fan blade that may be laser shock peened using the method and system of the present invention.
Figure 1:
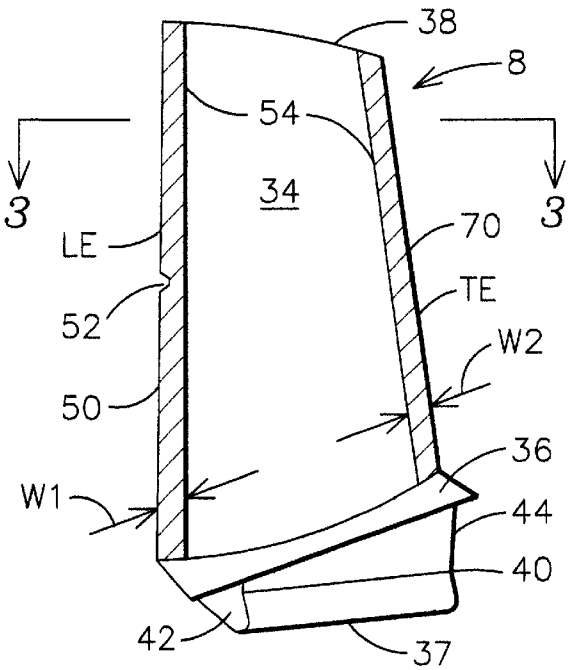
FIG. 1 is a perspective illustrative view of an exemplary article, i.e., an aircraft gas turbine engine fan blade, that may be laser shock peened using the method and system of the present invention.
Figure 3:
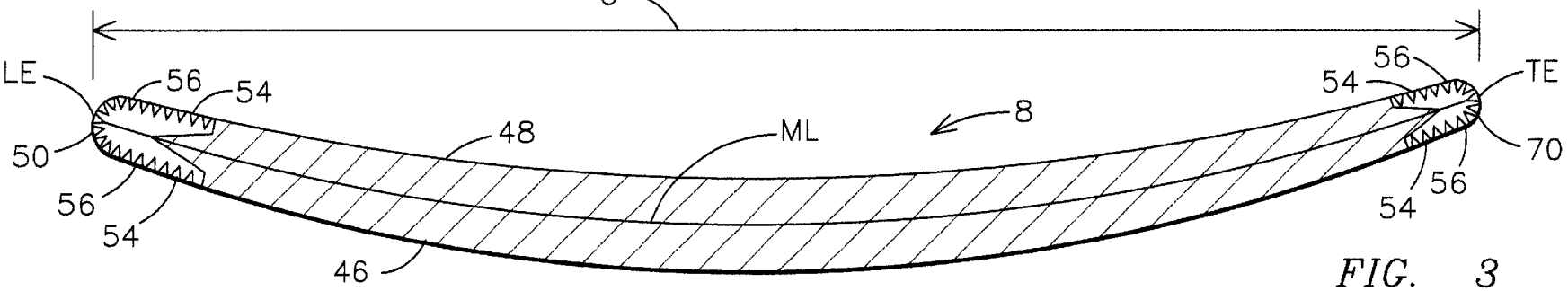
FIG. 3 is a cross sectional view through the fan blade taken along line 3—3 as illustrated in FIG. 2.

Illustrated in FIGS. 1, 2 and 3, is a fan blade 8 having an airfoil 34 made of a Titanium alloy extending radially outward from a blade platform 36 to a blade tip 38. This is representative of the type of hard metallic part and material that the method and system of the present invention was developed for. The fan blade 8 includes a root section 40 extending radially inward from the platform 36 to a radially inward end 37 of the root section 40. At the radially inward end 37 of the root section 40 is a blade root 42 which is connected to the platform 36 by a blade shank 44. The airfoil 34 extends in the chordwise direction between a leading edge LE and a trailing edge TE of the airfoil. A chord C of the airfoil 34 is the line between the leading LE and trailing edge TE at each cross section of the blade as illustrated in FIG. 2. A pressure side 46 of the airfoil 34 faces in the general direction of rotation as indicated by the arrow and a suction side 48 is on the other side of the airfoil and a mean-line ML is generally disposed midway between the two faces in the chordwise direction.

The fan blade 8 has a leading edge section 50 that extends along the leading edge LE of the airfoil 34 from the blade platform 36 to the blade tip 38. The leading edge section 50 includes a predetermined first width W1 such that the leading edge section 50 encompasses nicks 52 and tears that may occur along the leading edge of the airfoil 34. The airfoil 34 may be subject to a significant tensile stress field due to centrifugal forces generated by the fan blade 8 rotating during engine operation. The airfoil 34 may also subject to vibrations generated during engine operation and the nicks 52 and tears operate as high cycle fatigue stress risers producing additional stress concentrations around them.

To counter fatigue failure of portions of the blade along possible crack lines that can develop and emanate from incipient cracks or microcracks, nicks, and tears, mutually opposite first and second surfaces or sides of the article, such as the suction side 46 and the pressure side 48, have a respective laser shock peened surface area 54 with arrays 56 of pre-stressed volumetrically overlapping laser shock peened protrusions or spots having deep compressive residual stresses imparted by the dual laser shock peening (LSP) method and system of the present invention.

Figure 4:
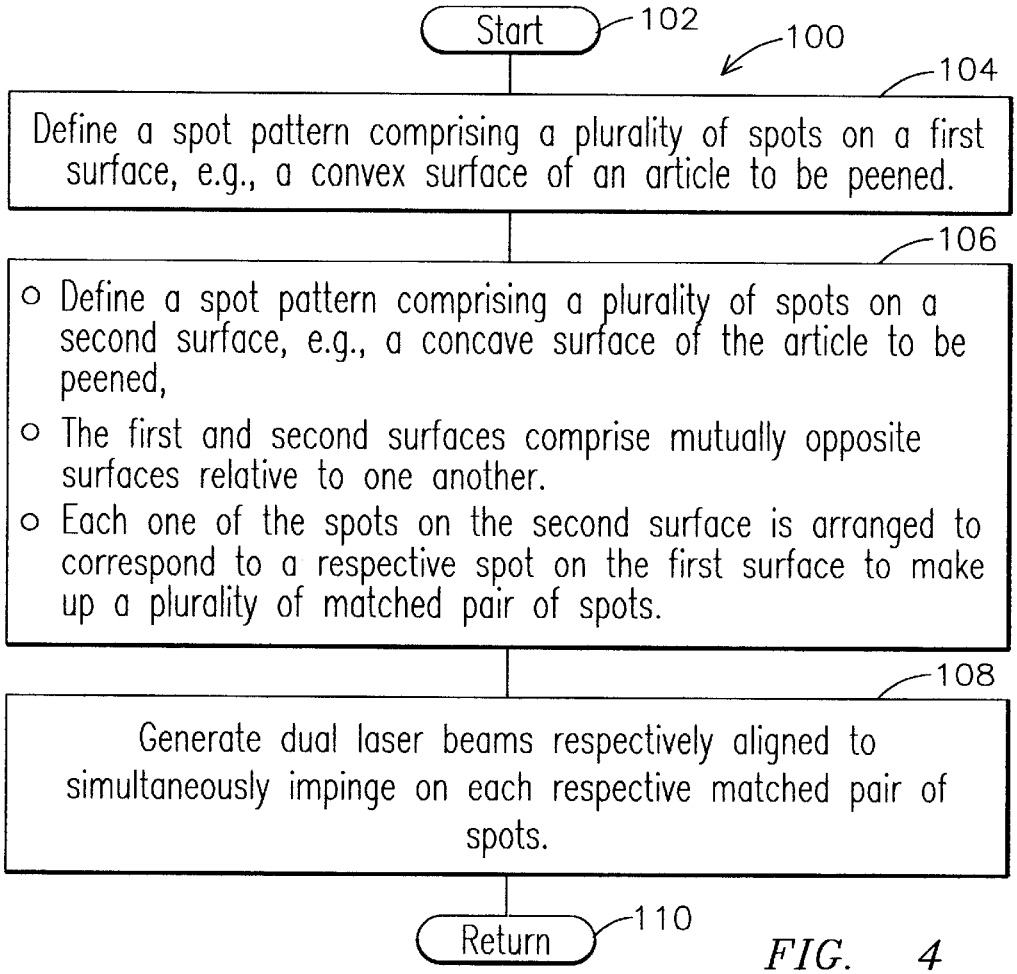
FIG. 4 is a flow chart of an exemplary embodiment of the method of the present invention that allows for determining the location of the spots at which respective dual laser beams strike mutually opposite surfaces of the article to be laser shock peened.

FIG. 4 shows a flow chart of an exemplary embodiment of the method 100 of the present invention that allows for determining the exact location of the spots at which the respective dual beams must strike the mutually opposite surfaces of the article to be laser shock peened (LSP). Subsequent to start step 102, step 104 allows for defining a spot pattern comprising a plurality of spots on a first surface of the article, e.g., a convex surface relative to an impinging laser beam. Step 106 allows for defining a spot pattern comprising a plurality of spots on a second surface of the article, e.g., a concave surface relative to the other impinging laser beam. As suggested above, the first and second surfaces (e.g., surfaces 46 and 48 (FIG. 1)) comprise mutually opposite surfaces relative to one another. Further, each one of the spots on the second surface is arranged to correspond to a respective spot on the first surface so as to make up a plurality of matched pair of spots. Prior to return step 110, step 108 allows for generating dual laser beams respectively aligned to simultaneously impinge on each respective matched pair of spots.

Figure 5:
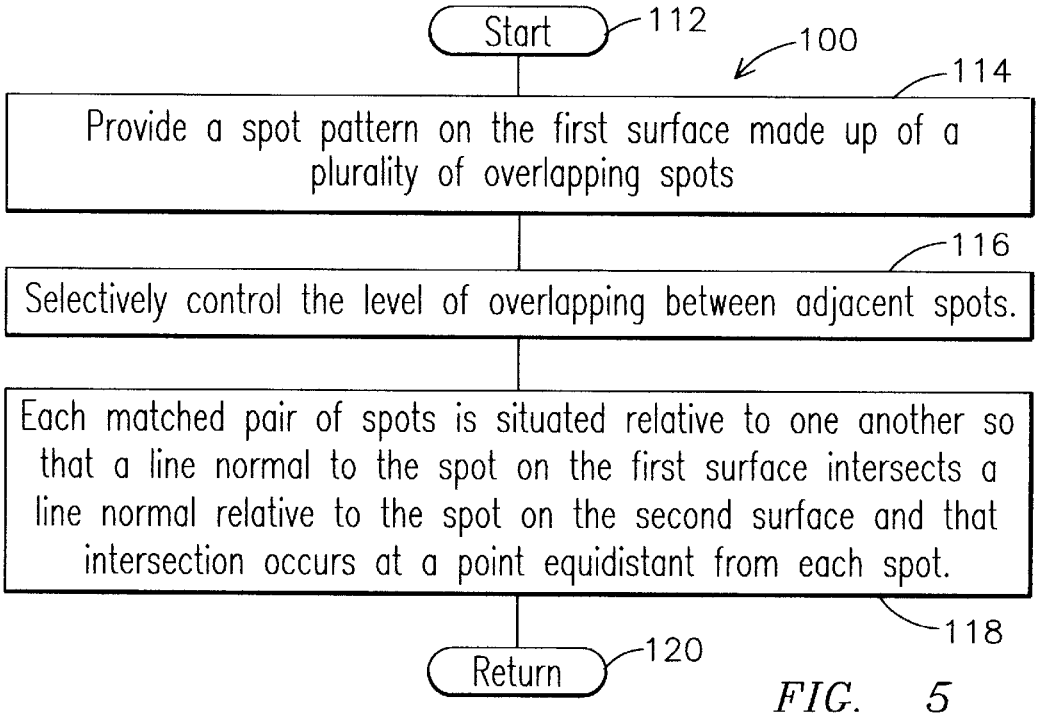
FIG. 5 is a flow chart illustrating further details regarding exemplary spot patterns, e.g., overlapping spots, that may be generated by the method of the present invention.
Figure 8:
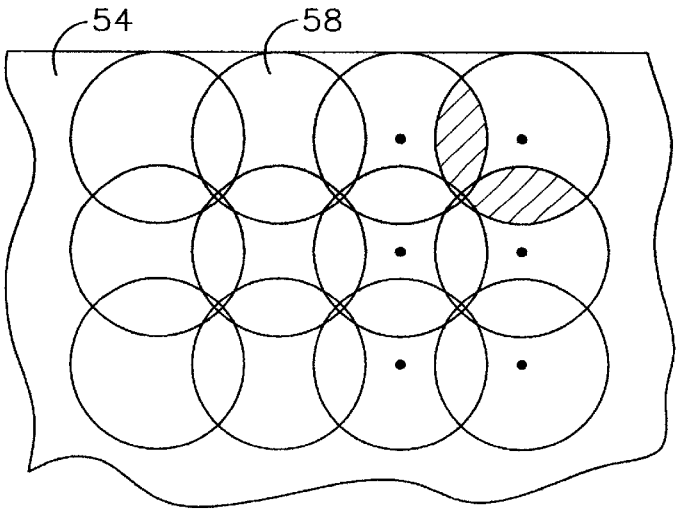
FIG. 8 is a plan view of an exemplary spot pattern that may be generated by the method of the present invention.
Figure 9:
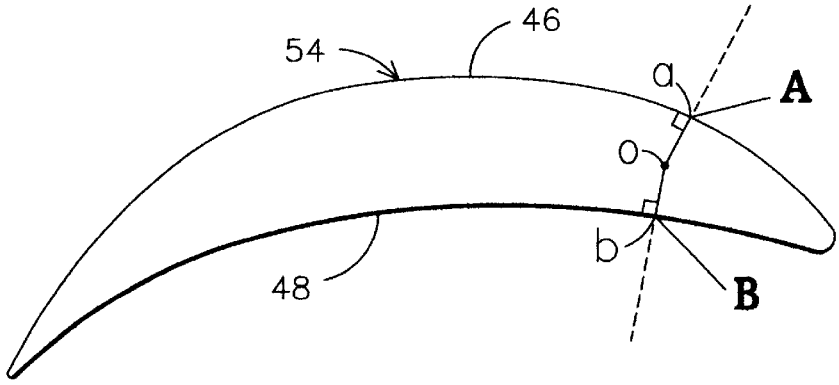
FIG. 9 is an elevational view of the article to be laser shock peened that illustrates geometrical relationships between a matched pair of spots to be struck by the dual laser beams.

FIG. 5 shows a flow chart illustrating further details in connection with the spot pattern that may be generated by method 100. Subsequent to start step 112, step 114 allows for providing a spot pattern on the first surface which pattern is made up of a plurality of overlapping spots. An example of such overlapping spot pattern is shown in FIG. 8. Step 116 allows for selectively controlling the level of overlapping between adjacent spots. As stated in block 118 and shown in FIG. 9, each matched pair of spots is situated relative to one another so that a line extending normal to the spot on the first surface (e.g., surface 48) intersects a line extending normal relative to the spot on the second surface (e.g., surface 46). The intersection of the two normal lines occurs at a point (e.g., point o) equidistant from each spot. The above described geometry is best appreciated in FIG. 9, wherein laser beam paths Aa and Bb are assumed to be co-planar, and it is further assumed that such paths are held in a fixed position and at fixed angle while simultaneously striking a respective matched pair of spots. Points a and b respectively correspond to the spot locations on the article where the laser beams will strike the article surface. More particularly, points a and b correspond to the respective centers of the spots situated on the respective mutually opposite surfaces of the article to be LSP. Thus, as shown in FIG. 9, the distance between line segment ao and line segment bo is identical to one another. Further, line segment ao is perpendicular to the spot center on first surface 46 of article 54. Similarly, line segment bo is perpendicular to the spot center on second surface 48 of article 54.

Figure 6:
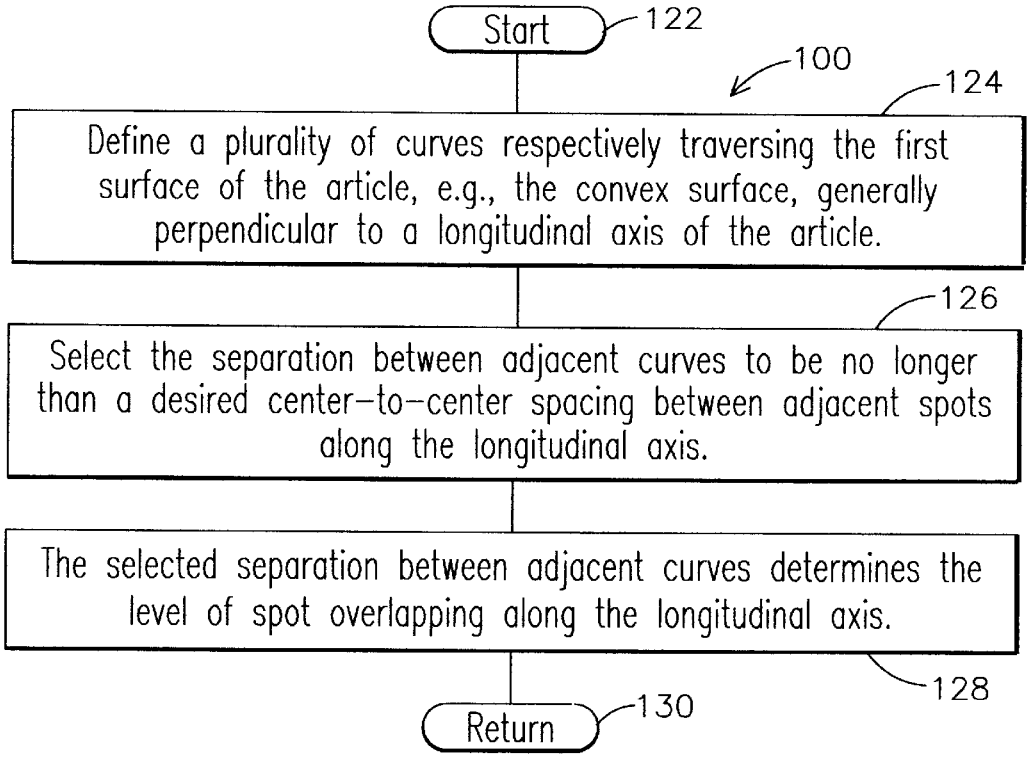
FIG. 6 is a flow chart illustrating steps for ensuring appropriate surface coverage of the article to be shock laser peened.

FIG. 6 is a flowchart that provides further details regarding another embodiment of method 100 that ensures that the plurality matched pair of spots completely cover the surfaces that are required to be LSP. Subsequent to start step 122, step 124 allows for defining a plurality of curves, such as curves 59 in FIG. 10, respectively traversing the first surface 46 of the article, e.g., the convex surface, generally perpendicular to a longitudinal axis (e.g., axis 60 (FIG. 10)) of the article. Step 126 allows for selecting the separation between adjacent curves to be no longer than a desired center-to-center spacing between adjacent spots along the longitudinal axis. Prior to return step 130, and as indicated in block 128, the selected separation between adjacent curves determines the level of spot overlapping along the longitudinal axis, and is represented by vertical arrows 64 in FIG. 10.

Figure 7:
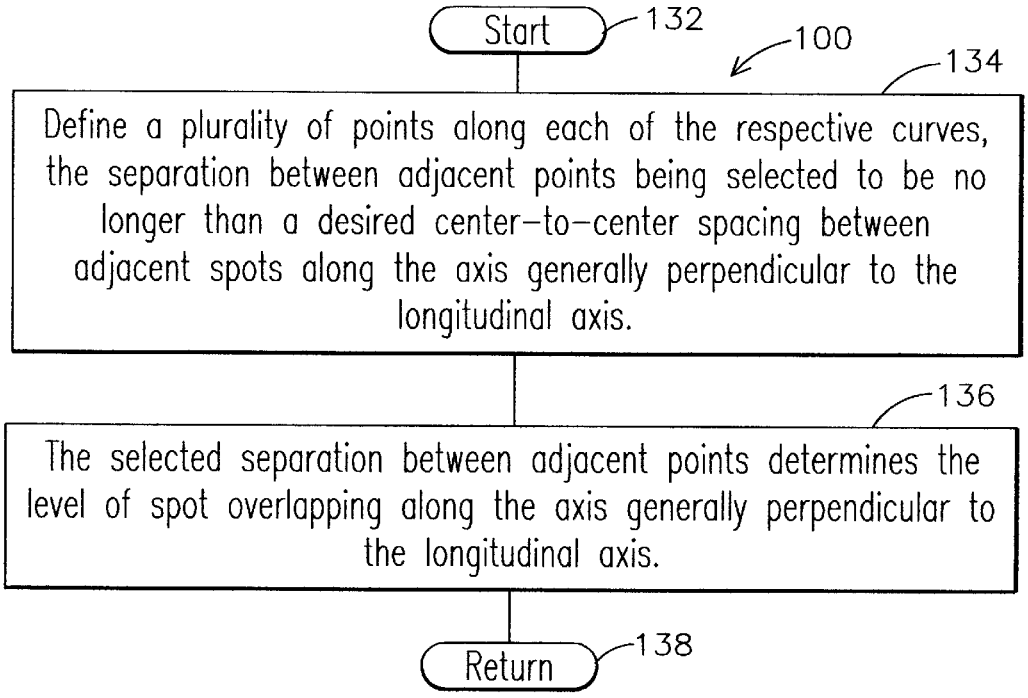
FIG. 7 is a flow chart that provides details for controllably selecting the level of overlapping between adjacent spots.
Figure 10:
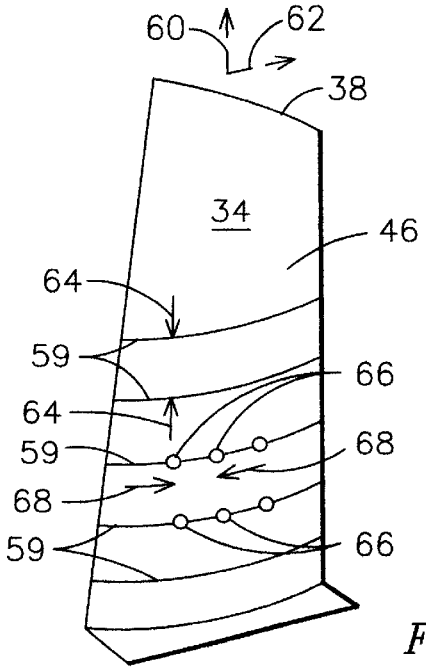
FIG. 10 is a perspective view illustrating geometrical relationships for controllably selecting the level of overlapping between adjacent spots.

FIG. 7 shows a flowchart that allows for selecting the level of spot overlapping along the axis generally perpendicular to the longitudinal axis of the article (e.g., axis 62 in FIG. 10). Subsequent to start step 132, step 134 allows for defining a plurality of points, such as points 66 in FIG. 10, along each of the respective curves. The separation between adjacent points is selected to be no longer than a desired center-to-center spacing between adjacent spots along the axis generally perpendicular to longitudinal axis of the article. Prior to return step 138, and as indicated in block 136, the selected separation between adjacent points determines the level of spot overlapping along the axis generally perpendicular to the longitudinal axis, and such point separation is represented by horizontal arrows 68 in FIG. 10.

Figure 11:
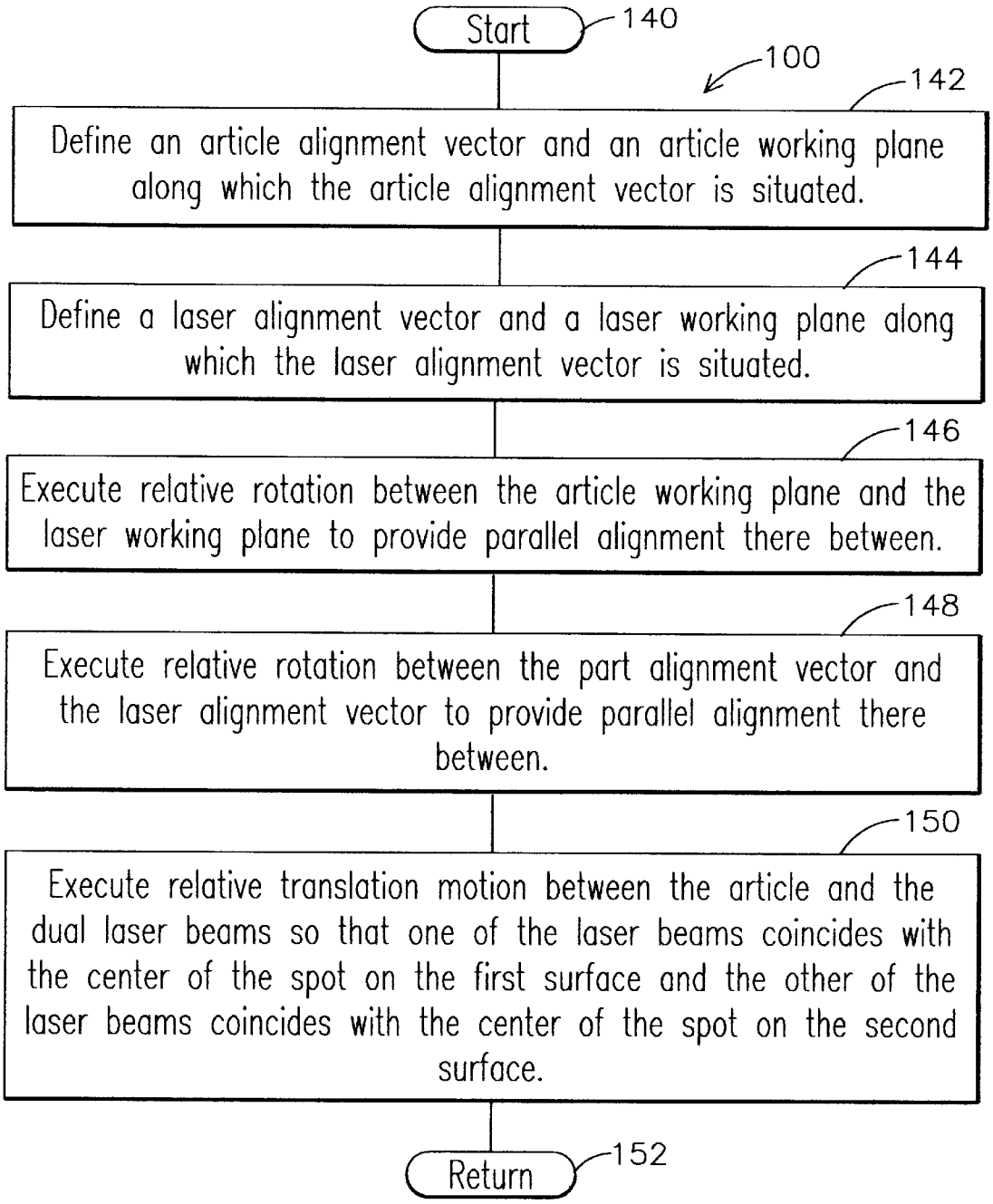
FIG. 11 is a flowchart used to illustrate steps that allow for three-dimensionally aligning the article relative to the dual laser beams.
Figures 12, 15:
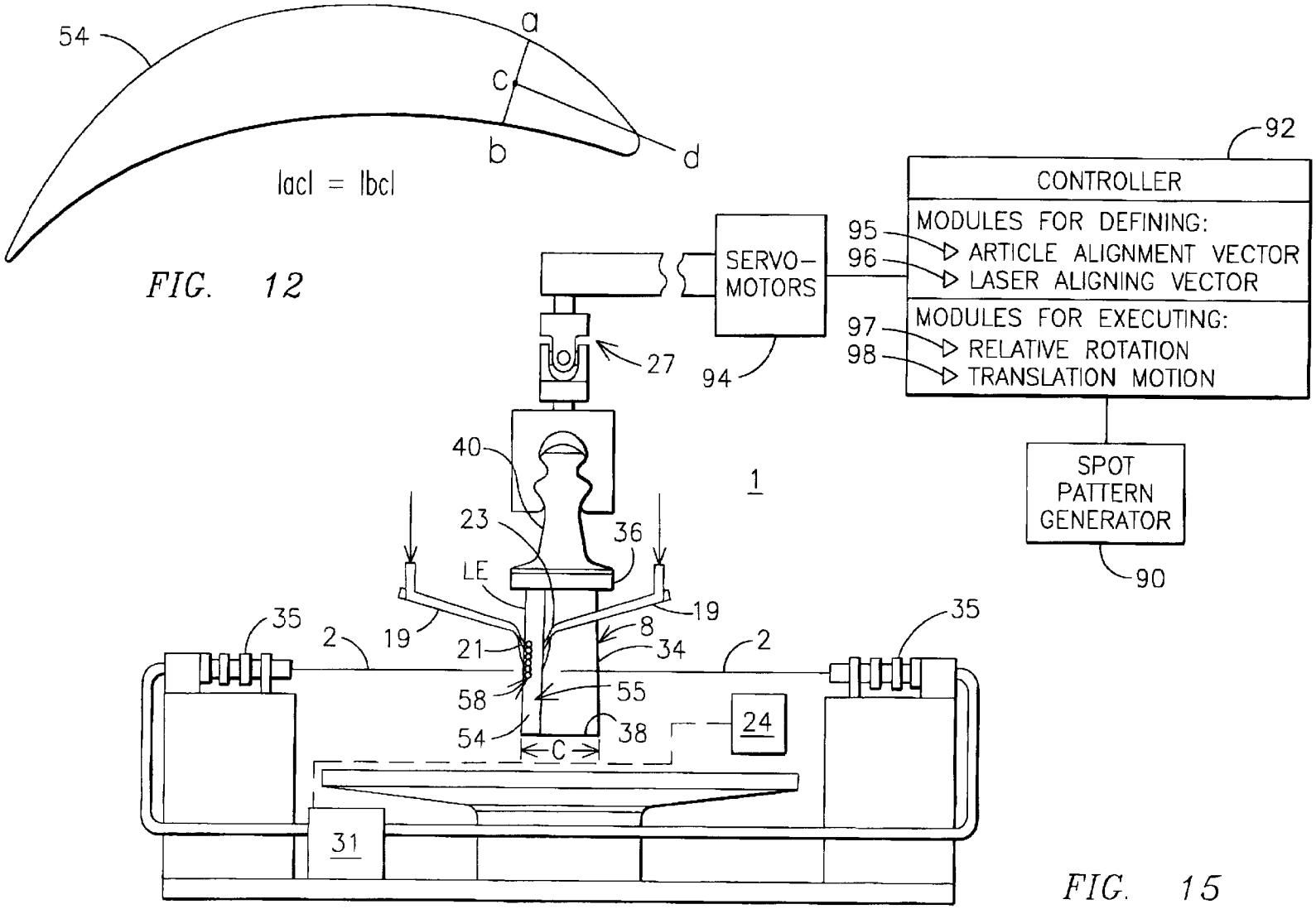
FIG. 12 is an elevational view of the article to be laser shock peened that illustrates geometrical relationships for defining an article alignment vector, and an article working plane.
FIG. 15 is a schematic perspective view of the blade of FIG. 1 coated and mounted in a laser shock peening system for implementing the method of the present invention.

FIG. 11 shows a flowchart that allows for determining the NC commands that are programmed into an article-positioning device to sequentially move the article to be LSP to precise locations so as to achieve three-dimensional alignment between the dual laser beams and each respective matched pair of spots. Subsequent to start step 140, step 142 allows for defining an article alignment vector and an article working plane along which the article alignment vector is situated. The article alignment vector and article working plane may be defined within a suitable Computer-Aided Design (CAD) model of article 54 as illustrated in FIG. 12. By way of example and not of limitation, a line segment between the two article spot points a and b is first defined. A center point of the line segment is then defined, e.g., center point c which is equidistant from points a and b. A vector CD extends from point c so that vector CD is normal relative to line segment ab. In this illustration, vector CD comprises the article alignment vector, and points a, b and article alignment vector CD define the article working plane.

Figure 13:
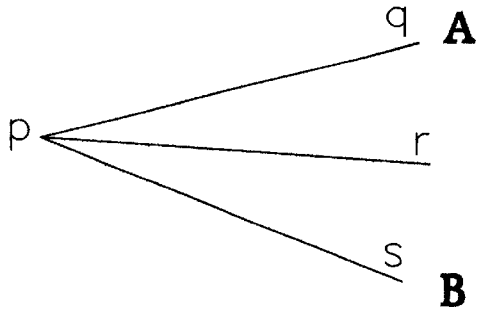
FIG. 13 is an arrangement of exemplary dual laser beams that illustrates geometrical relationships for defining a laser alignment vector, and a laser working plane.

Step 144 allows for defining a laser alignment vector and a laser working plane along which the laser alignment vector is situated. To define the laser alignment vector and the laser working plane, we assume a fixed dual laser beam arrangement, as shown in FIG. 13. It is further assumed that the dual laser beams A and B intersect at a known point p at a known fixed angle qps. To define the laser alignment vector, a line segment pr that bisects the angle qps is extended between the dual laser beams A and B. In this case, line segment pr comprises the laser alignment vector and the laser working plane is defined by the common plane shared by dual laser beams A and B and the laser alignment vector pr.

Step 146 allows for executing relative rotation between the article working plane and the laser working plane to provide parallel alignment between the article working plane and the laser working plane. Step 148 allows for executing relative rotation between the part alignment vector and the laser alignment vector to provide parallel alignment between such vectors. Prior to return step 152, step 150, which is reached through a connecting node A, allows for executing relative translation motion between the article and the dual laser beams so that one of the laser beams coincides with the center of the spot on the first surface of the article and the other of the laser beams coincides with the center of the spot on the second surface to be LSP.

Figure 14:
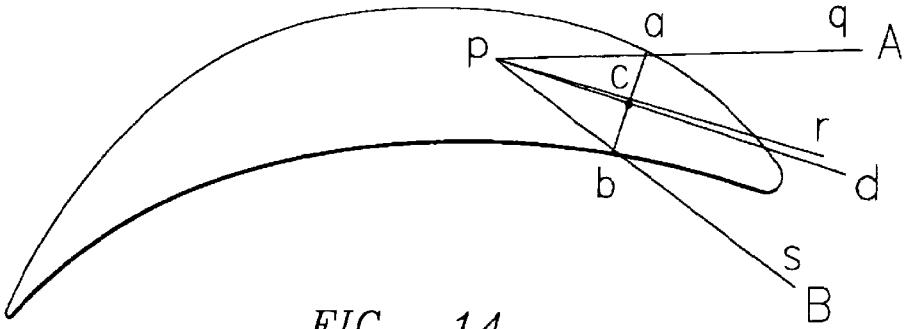
FIG. 14 is an elevational view that results from the combination of FIGS. 12 and 13 upon three-dimensional alignment relative to one another.

It will be appreciated by those skilled in the art, that traditional NC control techniques would only require aligning the article alignment vector to a single tool axis alignment vector. However, it will be further appreciated that such traditional technique would not work in a case that requires simultaneous control of a dual laser beam. Thus, this invention has recognized the need of executing an additional alignment, namely, alignment between the article working plane and the laser working plane. The above described alignment arrangement is illustrated in FIG. 14 wherein the laser alignment vector and the article alignment vector are aligned to share a common working plane such that the center lines of dual laser beams A and B respectively, pass through points a and b, which correspond to the center of the spots on the mutually opposite surfaces to be LSP.

Figure 16:
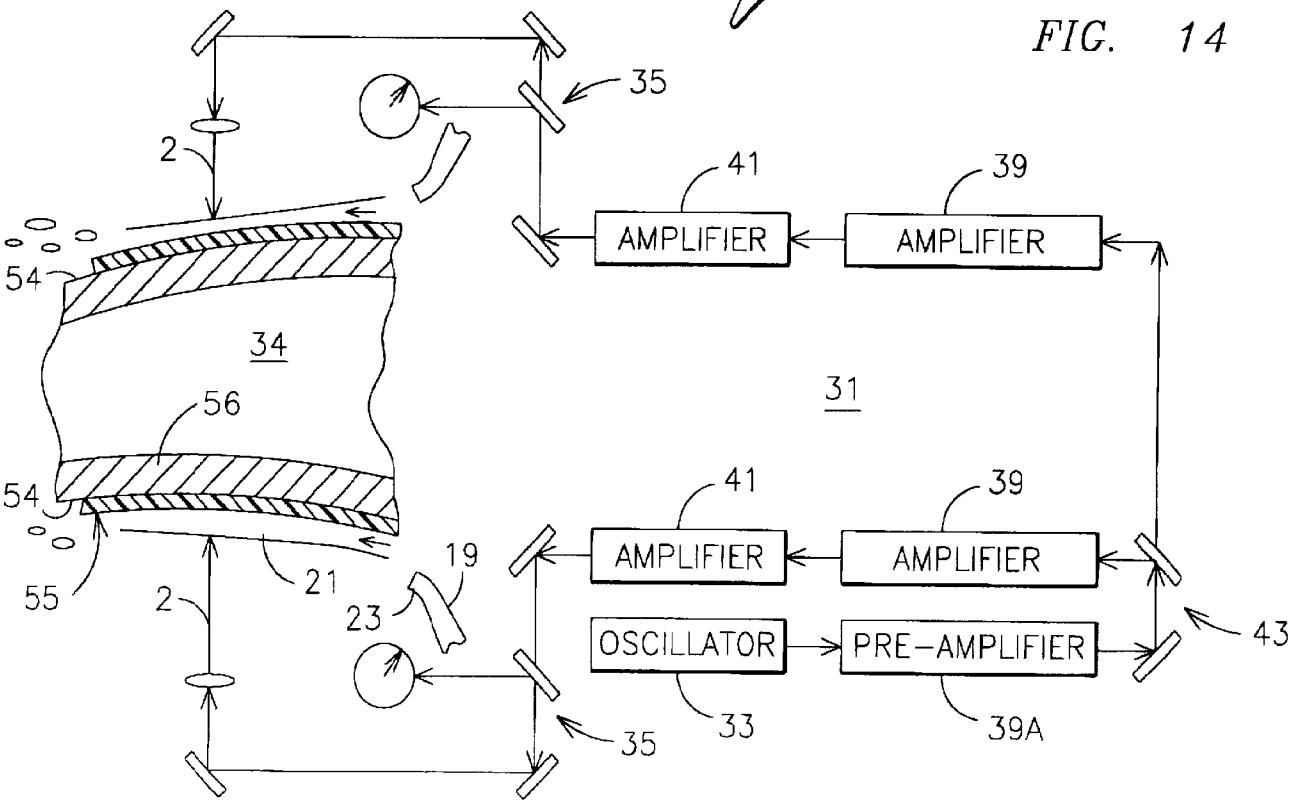
FIG. 16 is a partial cross-sectional and a partial schematic view of the setup of FIG. 15.

Referring to FIGS. 15 and 16, the laser beam shock induced deep compressive residual stresses are produced by repetitively firing two laser beams 2, each of which is defocused plus/minus a few mils with respect to the surfaces 54 on both sides of the leading edge LE which may be covered with any suitable ablative coating 55. The laser beam is preferably fired through a curtain of flowing water that is flowed over the coated laser shock peened surface 54. The paint, tape, or other ablative coating 55 is ablated generating plasma which results in shock waves on the surface of the material. Other ablative materials may be used to coat the surface as suitable alternatives to paint. These coating materials include metallic foil or adhesive plastic tape as disclosed in U.S. Pat. Nos. 5,674,329 and 5,674,328. These shock waves are re-directed towards the coated surface by the curtain of flowing water to generate travelling shock waves (pressure waves) in the material below the coated surface. The amplitude and quantity of these shock-wave determine the depth and intensity of compressive stresses. The ablative coating is used to protect the target surface and also to generate plasma.

Illustrated in FIGS. 15 and 16 is a system 1 which has the blade 8 mounted in a conventionally well-known robotic arm 27 used to continuously move and position the blade to provide laser shock peening "on the fly" in accordance with one embodiment of the present invention. Robotic arm 27 is responsive to rotational and/or linear motion imparted by suitable servomotors 94 that are turn responsive to suitable commands from a controller 92, e.g., an NC device, that may be programmed to implement the alignment steps discussed in the context of FIGS. 11–14. For example, a Module 95 is provided for defining an article alignment vector and an article working plane along which the article alignment vector is situated. A module 96 is provided for defining a laser alignment vector and a laser working plane along which the laser alignment vector is situated. A module 97 is provided for executing relative rotation between the article working plane and the laser working plane to provide parallel alignment between the article alignment vector and the laser alignment vector. A module 98 is provided for executing relative translation motion generating dual laser beams being respectively aligned to simultaneously impinge on each respective matched pair of spots. A spot pattern generator 90 may be further programmed to implement the spot pattern defining steps discussed in the context of FIGS. 4–10. It will be appreciated that the above programming may be implemented using programming techniques that are well-known and are well-understood to one of ordinary skill in the art.

The laser shock peened surfaces 54 on both the pressure and suction sides 46 and 48, respectively of the leading edge LE are coated with the ablative coating 55. Then the blade 8 is continuously moved while continuously firing the stationary laser beams 2 through a curtain of flowing water 21 on the surfaces 54 and forming the controllably overlapping laser shock peened circular spots 58. The curtain of water 21 is illustrated as being supplied by a conventional water nozzle 23 at the end of a conventional water supply tube 19. The laser shock peening system 1 has a conventional generator 31 with an oscillator 33 and a pre-amplifier 39A and a beam splitter 43 which feeds the pre-amplified laser beam into two beam optical transmission circuits each having a first and second amplifier 39 and 41, respectively, and optics 35 which include optical elements that transmit and focus the laser beam 2 on the laser shock peened surfaces 54. A controller 24 may be used to modulate and control the laser beam apparatus 1 to fire the laser beams 2 on the laser shock peened surfaces 54 in a controlled manner. Ablated coating material is washed out by the curtain of flowing water.

The laser may be fired sequentially "on the fly" so that the laser shock peened surface 54 is laser shock peened with more than one sequence of coating the surface and then laser shock peening the surface while continuously effecting movement between the airfoil 34 of blade 8 and the laser beams 2 as illustrated in FIGS. 15 and 16. In the illustrative embodiment herein, the airfoil 34 is moved while continuously firing the laser beams 2 on the surfaces 54 such that respective matched pairs of circular spots are simultaneously impinged by the dual laser beams. The sequence of coating and laser shock peening may be repeated several times to attain a desired strength of compressive residual stresses and depth of the laser shock peened protrusions 53.

It will be appreciated by those skilled in the art that method may be adapted so that only virgin or near virgin coating is ablated away without any appreciable effect or damage on the surface of the airfoil. This is to prevent even minor blemishes or remelt due to the laser which might otherwise cause unwanted aerodynamic effects on the blade's operation. Several sequences may be required to cover the entire pattern and re-coating of the laser shock peened surfaces 54 is done between each sequence of laser firings wherein each spot pair is hit several times. The laser firing has multiple laser firings or pulses with a period between firings that is often referred to a "rep". During the rep the part is moved so that the next pulse occurs at the location of the next laser shocked peened circular spot pair. Preferably, the part is moved continuously and timed to be at the appropriate location at the pulse or firing of the laser beam. One or more repeats of the sequence may be used to hit each laser shocked peened circular spot pair more than once. This may also allow for less laser power to be used in each firing or laser pulse.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A method for controlling three-dimensional alignment of dual laser beams for shock peening an article, the method comprising:

defining a spot pattern comprising a plurality of spots on a first surface of the article to be peened;

defining a spot pattern comprising a plurality of spots on a second surface of the article to be peened, the first and second surfaces comprising mutually opposite surfaces relative to one another, each one of the respective spots on the second surface being arranged to correspond to a respective spot on the first surface and comprising a plurality of matched pair of spots;

generating dual laser beams being respectively aligned to simultaneously impinge on each respective matched pair of spots, wherein the three dimensional alignment of the dual laser beams relative to the article comprises:

defining an article alignment vector and an article working plane along which the article alignment vector is situated;

defining a laser alignment vector and a laser working plane along which the laser alignment vector is situated;

executing relative rotation between the article working plane and the laser working plane to provide parallel alignment between the article alignment vector and the laser alignment vector; and executing relative translation motion between the article and the dual laser beams so that one of the laser beams coincides with the center point of the spot on the first surface and the other of the laser beams coincides with the center point of the spot on the second surface.

2. The method of claim 1 wherein the first surface comprises a convex surface.

3. The method of claim 2 wherein the spot pattern on the first surface comprises a plurality of overlapping spots.

4. The method of claim 3 further comprising a step of selectively controlling the level of overlapping between adjacent spots.

5. The method of claim 2 wherein the second surface comprises a concave surface.

6. The method of claim 5 wherein each respective matched pair of spots is situated relative to one another so that a line being normal relative to the spot on the first surface intersects a line being normal relative to the spot on the second surface, the intersection occurring at a point equidistant from each spot.

7. The method of claim 4 wherein the step of defining the spot pattern on the first surface comprises defining a plurality of curves respectively traversing the convex surface of the article generally perpendicular to a longitudinal axis of the article.

8. The method of claim 6 wherein spatial separation between adjacent curves is selected to be no longer than a desired center-to-center spacing between adjacent spots along the longitudinal axis.

9. The method of claim 8 wherein the selected separation between adjacent curves determines the level of spot overlapping along the longitudinal axis.

10. The method of claim 7 wherein the step of defining the spot pattern on the first surface further comprises defining a plurality of points along each of the respective curves, spatial separation between adjacent points being selected to be no longer than a desired center-to-center spacing between adjacent spots along the axis generally perpendicular to the longitudinal axis.

11. The method of claim 10 wherein the selected separation between adjacent points determines the level of spot overlapping along the axis generally perpendicular to the longitudinal axis.

12. The method of claim 11 further comprising a step of defining respective points corresponding to the centers of each matched pair of spots.

13. A system for controlling three-dimensional alignment of dual laser beams for shock peening an article, the system comprising:

a spot pattern generator for defining a spot pattern comprising a plurality of spots on a first surface of the article to be peened, the pattern generator further defining a spot pattern comprising a plurality of spots on a second surface of the article to be peened, the first and second surfaces comprising mutually opposite surfaces relative to one another, each one of the respective spots on the second surface being arranged to correspond to a respective spot on the first surface and comprising a plurality of matched pair of spots;

a laser unit for generating dual laser beams being respectively aligned to simultaneously impinge on each respective matched pair of spots, wherein the three dimensional alignment of the dual laser beams relative to the article is performed by a processor comprising:

a module for defining an article alignment vector and an article working plane along which the article alignment vector is situated;

a module for defining a laser alignment vector and a laser working plane along which the laser alignment vector is situated;

a module for executing relative rotation between the article working plane and the laser working plane to provide parallel alignment between the article alignment vector and the laser alignment vector; and a module for executing relative translation motion between the article and the dual laser beams so that one of the laser beams coincides with the center point of the spot on the first surface and the other of the laser beams coincides with the center point of the spot on the second surface.

14. The system of claim 13 wherein the first surface comprises a convex surface.

15. The system of claim 14 wherein the spot pattern on the first surface comprises a plurality of overlapping spots.

16. The system of claim 15 further comprising an overlap control module for selectively controlling the level of overlapping between adjacent spots.

17. The system of claim 13 wherein the second surface comprises a concave surface.

18. The system of claim 13 wherein each respective matched pair of spots is situated relative to one another so that a line normal relative to the spot on. the first surface intersects a line normal relative to the spot on the second surface, the intersection occurring at a point equidistant from each spot.

19. The system of claim 15 wherein the spot pattern generator includes a module for defining a plurality of curves respectively traversing the convex surface of the article generally perpendicular to a longitudinal axis of the article.

20. The system of claim 19 wherein spatial separation between adjacent curves is selected to be no longer than a desired center-to-center spacing between adjacent spots along the longitudinal axis.

21. The system of claim 20 wherein the selected separation between adjacent curves determines the level of spot overlapping along the longitudinal axis.

22. The system of claim 19 wherein the module of the spot pattern generator further defines a plurality of points along each of the respective curves, spatial separation between adjacent points being selected to be no longer than the center-to-center spacing between adjacent spots along the axis generally perpendicular to the longitudinal axis.

23. The system of claim 22 wherein the selected separation between adjacent points determines the level of spot overlapping along the axis generally perpendicular to the longitudinal axis.

24. The system of claim 23 further comprising a module for defining respective points corresponding to the centers of each matched pair of spots.

* * * * *